United States Patent [19]

Contois et al.

[11] 4,045,220

[45] Aug. 30, 1977

[54] LOW COLOR PHOTOCONDUCTIVE INSULATING COMPOSITIONS COMPRISING NITROGEN-FREE PHOTOCONDUCTOR AND BENZOPYRILIUM SENSITIZER

[75] Inventors: Lawrence E. Contois, Webster; Charles J. Fox; Richard W. Stahr, both of Rochester, all of N.Y.

[73] Assignee: Eastman Kodak Company, Rochester, N.Y.

[21] Appl. No.: 595,990

[22] Filed: July 14, 1975

[51] Int. Cl.[2] ..... G03G 5/09

[52] U.S. Cl. ..... 96/1.6; 96/1.5 N; 96/1.7

[58] Field of Search ..... 96/1.5, 1.6, 1.7

[56] References Cited

U.S. PATENT DOCUMENTS

| | | | |
|---|---|---|---|
| 3,246,983 | 4/1966 | Sus et al. | 96/1.5 |
| 3,331,687 | 7/1967 | Kosche | 96/1.5 |
| 3,554,745 | 1/1971 | Van Allan | 96/1.6 |
| 3,577,235 | 5/1971 | Contois | 96/1.6 |
| 3,677,752 | 7/1972 | Looker et al. | 96/1.5 X |
| T 889,023 | 10/1970 | Reynolds | 96/1.6 |

FOREIGN PATENT DOCUMENTS

| | | | |
|---|---|---|---|
| 41-18467 | 10/1966 | Japan | 96/1.5 |
| 964,874 | 6/1964 | United Kingdom | 96/1.5 |

OTHER PUBLICATIONS

Kleinerman et al., "The Photoconductive and Emission Spectro-scope properties of Organic Molecular Materials", pp. 196, 219.

*Primary Examiner*—Edward C. Kimlin
*Attorney, Agent, or Firm*—R. P. Hilst

[57] ABSTRACT

Coloration resistant photoconductive insulating compositions useful in making elements, such as photoconductive electrophotographic papers, are provided. Such compositions comprise (1) an electrically insulating organic binder, (2) a nitrogen-free polyaryl hydrocarbon photoconductor such as those having the formula

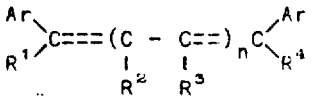

wherein:

*n* represents an integer having a value of 0, 1 or 2,

Ar represents an aryl group including substituted aryl such as phenyl, alkylphenyl having 1 to about 10 carbon atoms in the alkyl moiety, alkoxyphenyl having 1 to about 10 carbon atoms in the alkoxy moiety, and the like, each of $R^1$, $R^2$, $R^3$ and $R^4$ represents a hydrogen atom, an aryl group, an alkyl group or an alkoxy group and, when *n* is O, $R^1$ and $R^4$ are both aryl and when $R^1$ and $R^4$ are both hydrogen, each of $R^2$ and $R^3$ represents an aryl group; and (3) a sensitizer that is substantially non-color forming in the composition. Particularly useful such sensitizers include benzopyrylium type compounds.

28 Claims, No Drawings

LOW COLOR PHOTOCONDUCTIVE INSULATING COMPOSITIONS COMPRISING NITROGEN-FREE PHOTOCONDUCTOR AND BENZOPYRILIUM SENSITIZER

BACKGROUND OF THE INVENTION

1. Field of the Invention

This invention relates to electrophotography and in particular to coloration resistant photoconductive insulating compositions and elements and to processes using such compositions and elements.

2. Description of the Prior Art

The process of xerography, as disclosed by Carlson in U.S. Pat. No. 2,297,691, employs an electrophotographic element comprising a support material bearing a coating of an insulating material whose electrical resistance varies with the amount of incident electromagnetic radiation it receives, such as during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor or the like, or transferred to a second element to which it can similarly be fixed. Likewise, the electrostatic charge pattern can be transferred to a second element and developed there.

Various photoconductive insulating materials have been employed in the manufacture of electrophotographic elements. For example, vapors of selenium and vapors of selenium alloys deposited on a suitable support and particles of photoconductive zinc oxide held in a resinous, film-forming binder have found wide application in present-day document copying processes.

Since the introduction of electrophotography, a great many organic compounds have also been screened for their photoconductive properties. As a result, a very large number of organic compounds have been known to possess some degree of photoconductivity. Many organic compounds have revealed a useful level of photoconduction and have been incorporated into photoconductive compositions. Among these organic photoconductors are certain of the triphenylamines as described in U.S. Pat. No. 3,180,730 issued Apr. 27, 1965, and the polyarylalkane compounds such as those described in U.S. Pat. No. 3,274,000 issued Sept. 20, 1966; U.S. Pat. No. 3,542,547 issued Nov. 24, 1974; and in U.S. Pat. No. 3,615,402 issued Oct. 26, 1971.

Electrophotographic elements on which marking material is deposited and permanently affixed are often called direct recording or direct imaging materials. It is desirable that such materials exhibit no color or very low coloration in non-image background areas. As an example, it has long been an object to minimize background stain in electrophotographic papers, such as those intended for office copying or for making copies from microfilm such as on reader/printer equipment. In inorganic photoconductive materials, photoconductive metal oxides are often white in appearance. However, it has been difficult to prepare coloration-resistant (non-stain-producing) organic photoconductive materials, which can provide a considerable advantage over the inorganic photoconductive materials that are often weighty and unpleasant to handle. Such difficulty occurs for reasons such as: (1) interactions between the binder and the photoconductor that impart color to the element beyond that of the constituents, due to absorption of the reaction product in the visible region of the spectrum and (2) inherently poor light stability possessed by many of the most efficient organic photoconductors which tend to form coloration upon prolonged exposure to conventional room light. Additionally, background coloration is much more apparent and easily discerned by the naked eye when compositions are coated on white reflective supports than when coated on transparent supports.

Various dyes useful in sensitizing photoconductors have been described. U.S. Pat. Nos. 3,554,745 and 3,577,235 describe benzopyrylium sensitizers as useful in forming electrophotographic materials of lower background color when used in conjunction with, respectively, organic amine or amino substituted photoconductors and organometallic photoconductors. No suggestion of the relationship of reflective support materials to the problem of background coloration is made in these patents, nor is there any reference to nitrogen-free photoconductors that might reduce still further the amount of background color.

U.S. Pat. No. 3,246,983 describes certain ethylene derivative photoconductors. Such photoconductors are hydrogen substituted, as distinguished from the ethylene derivative photoconductors described herein which are tetraaryl substituted. Further, there is no indication in U.S. Pat. No. 3,246,983 of the ability to form coloration resistant photoconductive insulating compositions as described herein.

The problem of background color formation can be illustrated by preparing, using conventional techniques, a homogeneous electrographic paper in which the photoconductive layer includes Vitel$^R$ 101 polyester binder and 4,4'-diethylamino-2,2'-dimethyltriphenylmethane as a photoconductor. Neither of these compounds, taken separately, exhibits any appreciable absorption in the visible region of the spectrum. However, when they are mixed to form a photoconductive composition, a yellowish charge-transfer complex is produced. After several days exposure to normal office illumination, this electrographic paper changes to a green color.

A patent application of C. J. Fox, PHOTOCONDUCTIVE INSULATING COMPOSITIONS INCLUDING POLYARYL HYDROCARBON PHOTOCONDUCTORS, filed concurrently herewith U.S. Ser. No. 595,955, describes the combination of certain photoconductors derived from ethylene, butadiene and hexatriene with pyrylium salts and Lewis acids as sensitizers. Although the photoconductors of the Fox application include certain of the nitrogen-free photoconductors described in detail herein, there is no suggestion in the Fox application that such photoconductors, or the additional photoconductors of the present photoconductive compositions, could be combined with benzopyrylium sensitizers to produce coloration resistant photoconductive insulating compositions. The subject matter of this application is considered to provide desirable properties and results not suggested in the Fox application.

SUMMARY OF THE INVENTION

Such problems and difficulties have unexpectedly been overcome by means of the present invention which provides organic photoconductive insulating compositions that resist the formation of color in background regions. Such coloration resistant compositions include (1) an organic polymeric binder, (2) a nitrogen-free polyarylhydrocarbon photoconductor such as one having the formula (I):

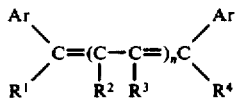

wherein:

*n* represents an integer having a value of 0, 1 or 2;

Ar represents an aryl group including substituted aryl such as phenyl, alkylphenyl having 1 to about 10 carbon atoms in the alkyl moiety like ethylphenyl, octylphenyl, tert-butylphenyl, alkoxyphenyl having 1 to about 10 carbon atoms in the alkoxy moiety like methoxyphenyl, propoxyphenyl, decoxyphenyl, and the like;

each of $R^1$, $R^2$, $R^3$ and $R^4$ represents a hydrogen atom, an aryl group (for example as defined above for Ar), an alkyl group having 1 to about 10 carbon atoms, an alkoxy group having 1 to about 10 carbon atoms and when *n* is 0, $R^1$ and $R^4$ are both aryl and when $R^1$ and $R^4$ are both hydrogen $R^2$ and $R^3$ are each an aryl group, and (3) a substantially colorless benzopyrylium type sensitizer for the photoconductor. As the photoconductor is free from nitrogen atoms, it will be understood that the Ar and various R groups do not include nitrogen atoms.

DESCRIPTION OF THE PREFERRED EMBODIMENTS

In accordance with the invention photoconductive insulating compositions are provided, such compositions including an organic polymeric binder, a nitrogen-free polyaryl hydrocarbon photoconductor such as those having the structure of formula I above, and a substantially colorless benzopyrylium type sensitizer for the photoconductor, i.e., a sensitizer including one or more aromatic groups of the benzene series fused to a pyrylium, thiapyrylium, selenapyrylium, etc., ring, such as a sensitizer having a benzopyrylium, benzothiapyrylium, benzoselenapyrylium, naphthopyrylium moiety, etc.

Nitrogen-free photoconductors that are particularly useful in the practice of this invention are those of formula I above in which *n* is an integer having a value of 0 or 1 and at least one of $R^1$ and $R^4$ is an aryl group as defined above for Ar when *n* is 1. Preferred photoconductors include those having the formula (II):

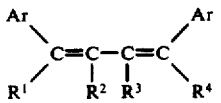

wherein each Ar and $R^1$, $R^2$, $R^3$ and $R^4$ are as described herein.

Photoconductors useful in the practice of this invention include:

1,1,4,4-tetraphenyl-1,3-butadiene,
1,2,3,4-tetraphenyl-1,3-butadiene,
1,6-diphenyl-1,3,5-hexatriene,
1,1,4-triphenylbutadiene,
1,6-diphenyl-1,3,5-hexatriene,
1,4-diphenyl-1,3-butadiene, and
tetraphenylethylene.

It will be understood that the term hydrocarbon, as used in connection with photoconductors described herein, refers to the polyarylalkene moiety of the photoconductor. Substituents additional to hydrocarbon groups can be present on such polyarylalkene moiety, but they are free from nitrogen atoms and otherwise preferably do not induce color formation in the composition.

A number of binders useful in forming the photoconductive insulating compositions of this invention are described in Dessauer and Clark, "Xerography and Related Process," Focal Press, Ltd., 1965, at page 165. Typically, these binders are film-forming polymeric materials having a fairly high dielectric strength and good electrically insulating properties. Useful binders include:

I. Natural resins including gelatin, cellulose ester derivatives such as alkyl esters of carboxylated cellulose hydroxy ethyl cellulose, carboxy methyl cellulose, carboxy methyl hydroxy ethyl cellulose, etc.;

II. Vinyl resins including a. polyvinyl esters such as a vinyl acetate resin, a copolymer of vinyl acetate and crotonic acid, a copolymer of vinyl acetate with an ester of vinyl alcohol and a higher aliphatic carboxylic acid such as lauric acid or stearic acid, polyvinyl stearate, a copolymer of vinyl acetate and maleic acid, a poly(vinylhaloarylate) such as poly(vinyl-m-bromo-benzoate-co-vinyl acetate, a terpolymer of vinyl butyral with vinyl alcohol and vinyl acetate, etc.;

b. vinyl chloride and vinylidene chloride polymers such as a poly(vinylchloride), a copolymer of vinyl chloride and vinyl isobutyl ether, a copolymer of vinylidene chloride and acrylonitrile, a terpolymer of vinyl chloride, vinyl acetate and vinyl alcohol, poly(vinylidene chloride) a terpolymer of vinyl chloride, vinyl acetate and maleic anhydride, a copolymer of vinyl chloride and vinyl acetate, etc.;

c. styrene polymers such as polystyrene, a nitrated polystyrene, a copolymer of styrene and monoisobutyl maleate, a copolymer of styrene with methacrylic acid, a copolymer of styrene and butadiene, a copolymer of dimethylitaconate and styrene, polymethylstyrene, etc.;

d. methacrylic acid ester polymers such as a poly(alkylmethacrylate), etc.;

e. polyolefins such as chlorinated polyethylene, chlorinated polypropylene, poly(isobutylene), etc.;

f. poly(vinyl acetals) such as poly(vinyl butyral, etc.; and g. poly(vinyl alcohol);

III. Polycondensates including a. a polyester of 1,3-disulfobenzene and 2,2-bis(4-hydroxyphenyl)propane;

b. a polyester of diphenyl-p,p'-disulphonic acid and 2,2-bis(4-hydroxyphenyl)propane;

c. a polyester of 4,4'-dicarboxyphenyl ether and 2,2-bis(4-hydroxyphenyl)propane;
d. a polyester of 2,2-bis(4-hydroxyphenyl)-propane and fumaric acid;
e. polyester of pentaerythritol and phthalic acid;
f. resinous terpene polybasic acid;
g. a polyester of phosphoric acid and hydroquinone;
h. polyphosphites;
i. polyester of neopentylglycol and isophthalic acid;
j. polycarbonates including polythiocarbonates such as the polycarbonate of 2,2-bis(4-hydroxyphenyl)-propane;
k. polyester of isophthalic acid, 2,2-bis[4-(β-hydroxyethoxy)phenyl]propane and ethylene glycol;
l. polyester of terephthalic acid, 2,2-bis[4-(β-hydroxyethoxy)phenyl]propane and ethylene glycol;
m. polyester of ethylene glycol, neopentyl, glycol, terephthalic acid and isophthalic acid;
n. polyamines;
o. ketone resins; and
p. phenol-formaldehyde resins;

IV. Silicone resins;

V. Alkyd resins incuding styrene-alkyd resins, silicone-alkyd resins, soya-alkyd resins, etc.;

VI. Polyamides;

VII. Paraffin; and

VIII. Mineral waxes.

Methods of making resins of this type have been described in the prior art, for example, styrene-alkyd resins can be prepared according to the method described in the prior art, for example, styrene-alkyd resins can be prepared according to the method described in Gerhart U.S. Pat. No. 2,361,019 issued Oct. 24, 1944 and Rust U.S. Pat. No. 2,558,423 issued Oct. 7, 1941. Suitable resins of the type contemplated for use in the photoconductive layers of the invention are sold under such tradenames as VITEL PE-101, CYMAC Piccopale 100, Saran F-220, and LEXAN 145. Other types of binders which can be used in photoconductive layers include such materials as paraffin, mineral waxes, etc., as well as combinations of binder materials.

In the practice of the present invention, particularly preferred binders include for example chlorinated polyethylene (65%) chlorine, Geon$^R$ 222, a vinylidene chloride-vinyl chloride copolymer from B. F. Goodrich Co., and Vitel$^R$ 101, a polyester from Goodyear Co.

The sensitizers useful in the present invention include a variety of substantially colorless benzopyrylium type sensitizing dyes that are sensitizers for the photoconductors described herein. Substantially colorless as used herein means the sensitizer tends to absorb negligible radiation greater than 420 nm and only a minor amount of radiation having a wavelength of 400 nm or greater. Typically, such sensitizers have a formula as follows:

II.

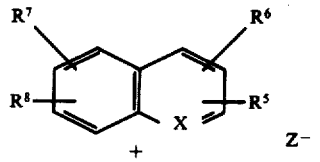

wherein:

X is a sulfur atom or an oxygen atom;

Z is an anion including acid anions such as perchlorate, fluoroborate, sulfonate, periodate, p-toluenesulfonate, etc;

$R^5$ represents an aryl group such as phenyl or naphthyl, including substituted aryl like phenyl having such substituents as a lower alkyl group typically having 1 to 4 carbon atoms such as methyl, ethyl, isopropyl, butyl, etc, and a lower alkoxy group typically having 1 to 4 carbon atoms in the alkyl moiety such as methoxy, ethoxy, propoxy, butoxy, etc;

$R^6$ represents an amino group including substituted amino having such substituents as an alkyl group typically having 1 to 10 carbon atoms, such as methyl, ethyl, isopropyl, n-butyl, pentyl, octyl, decyl, etc, including cycloalkyl such as cyclopentyl, cyclohexyl, etc, as well as such substituted alkyl radicals as an aralkyl group typically having 1 to 4 carbon atoms in the alkyl moiety such as benzyl, phenylethyl, phenylpropyl and phenylbutyl; an aryl radical such as phenyl and naphthyl radicals; and the like; and $R^7$ and $R^8$ when taken separately, each represents a hydrogen atom and when taken together are attached to adjacent carbon atoms and represent the atoms necessary to form a fused 5- or 6-membered aromatic ring and including substituted fused aromatic rings having such substituents as an alkyl or alkoxy group as defined above for $R^1$ and $R^2$.

The sensitizers used in preferred embodiments of the present invention are those of formula II in which X is an oxygen atom; $R^5$ is a phenyl group or as substituted phenyl having such substituents as a lower alkyl group and a lower alkoxy group as described above and $R^5$ is located in the 2-position relative to X; $R^6$ is an alkyl- or alkoxyamino group having 1 to 18 carbon atoms in the alkyl or alkoxy moiety and is attached at the 4-position relative to X; and $R^7$ and $R^8$ each represent a hydrogen atom.

Particularly useful dye sensitizers include for example:

4-n-butylamino-2-(4methoxyphenyl)-benzo[b]-pyrylium perchlorate,
4-cyclohexylamine-2-phenylbenzo[b]thiapyrylium perchlorate,
4-n-butylamino-2-(2-naphthyl)naphtha[1,2-b]pyrylium perchlorate, Other benzopyrylium type sensitizers are described in U.S. Pat. No. 3,554,745.

The photoconductive insulating compositions of this invention are prepared conveniently, typically by preparing a solution of the photoconductor, sensitizer and binder.

Solvents useful for preparing coating compositions containing the photoconductors of the present invention can include a wide variety of organic solvents for the components of the coating composition.

Typical solvents include:

1. Aromatic hydrocarbons such as benzene, naphthalene, etc., including substituted aromatic hydrocarbons such as toluene, xylene, mesitylene, etc.;
2. Ketones such as acetone, 2-butanone, etc.;
3. Halogenated aliphatic hydrocarbons such as methylene chloride, chloroform, ethylene chloride, etc.;
4. Ethers including cyclic ethers such as tetrahydrofuran, ethyl ether;
5. Mixtures of the above.

In preparing the photoconductive insulating compositions, useful results are obtained where the photoconductor substance is present in an amount equal to at least about 1 weight percent of the composition (i.e. solids content). The upper limit in the amount of photoconductor substance present can be widely varied in accordance with usual practice. Where a binder is employed, it is normally required that the photoconductor substance be present in an amount from about 1 weight percent of the composition to about 99 weight percent of the composition. A preferred weight range for the photoconductor substance in the composition is from about 10 weight percent to about 60 weight percent.

Generally, a suitable amount of the sensitizing compound is mixed with the photoconductive insulating composition so that after thorough mixing the sensitizing compound is uniformly distributed throughout the composition. The amount of sensitizer that can be added to give effective increases in speed can vary widely. The optimum concentration in any given case will vary with the specific photoconductor and sensitizing compound used. In general, substantial speed gains can be obtained where an appropriate sensitizer is added in a concentration range from about 0.0001 to about 30 percent by weight based on the weight of the photoconductive insulating composition. For purposes of the present invention, it is advantageous to keep the sensitizer concentration as low as possible, but high enough to maintain appropriate sensitometry. If the composition is designed to be used for microfilm reader/printer-type exposures, the preferred range for the dye sensitizer concentration is from about 0.03 to about 0.6 weight percent, although lower or greater amounts can produce satisfactory results.

The compositions of this invention can be used without associated materials, as when coated to form a self supporting layer. This can be accomplished by coating the composition on a non-adherent surface and stripping off the coated layer, when dry, to obtain a self-supporting photoconductive insulating member. Typically, photoconductive insulating compositions of the type described herein are coated on an electrically conducting support material to prepare electrophotographic elements.

Suitable supporting materials on which photoconductive insulating layers can be coated include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum electrically conducting metals intermixed with protective inorganic oxides such as Cr with SiO (as described in U.S. Pat. No. 3,880,657) and the like coated on paper or conventional photographic film bases such as cellulose acetate, polystyrene, etc. The low color photoconductive insulating compositions described herein are especially desirable for use on paper or other supports that may be used for the reflection viewing of images.

Conducting materials such as nickel can be vacuum deposited on transparent film supports in sufficiently thin layers to allow electrophotographic elements prepared therewith to be exposed from either side of such element. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy issued Apr. 12, 1966. Likewise, a suitable conducting coating can be prepared from the sodium salt of a carboxy ester lactone of maleic anhydride and a vinyl acetate polymer. Such kinds of conducting layers and methods for their optimum preparation and use are disclosed in U.S. Pat. No. 3,007,901 by Minsk issued Nov. 7, 1961, and 3,262,807 by Sterman et al issued July 26, 1966.

Coating thicknesses of the photoconductive composition of the invention on a suitable support can vary widely. Normally, a coating in the range of about 10 microns to about 300 microns before drying is useful for the practice of this invention. The preferred range of coating thickness is found to be in the range from about 50 microns to about 150 microns before drying, although useful results can be obtained outside of this range. The resultant dry thickness of the coating is preferably between about 2 microns and about 50 microns, although useful results can be obtained with a dry coating thickness between about 1 and about 200 microns.

Photoconductive elements according to the present invention can be employed in any of the well-known electrophotographic processes which require photoconductive layers. One such process is the xerographic process. In a process of this type, an electrophotographic element is held in the dark and given a blank electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, by contact printing, by lens projection of an image or the like, to form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically-responsive particles having optical density. The developing electrostatically-responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. Pat. Nos. 2,786,439 by Young issued Mar. 26, 1957; 2,786,440 by Giaimo issued Mar. 26, 1957; 2,786,441 by Young issued Mar. 26, 1957; 2,874,063 by Grieg issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example U.S. Pat. No. 2,907,674 by Metcalfe et al issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review" Vol. 15 (1954) pages 469–484.

The following examples provide a further illustration of the present invention:

EXAMPLE 1

A photoconductive solution was prepared containing the following ingredients:

| | |
|---|---|
| dichloromethane | 4680 g |
| Chlorinated polyethylene | 384 g |
| 1,1-bis(4-N,N-diethylamino-2-methylphenyl)-2-methyl propane* | 160 g |
| 4-(n-butylamino)-2-(4-methoxyphenyl)-benzo[b]pyrylium perchlorate | 1.92 g |
| Arochlor® 1254 (a chlorinated biphenyl) | 96 g |
| Polyethylene beads Microthene® FN510 | 6.4 g |

*Not a photoconductor used in the present invention

This homogeneous solution was coated at 1.0 g/ft$^2$ (dry coverage) on a conductive paper support supplied by Weyerhauser Company as Conducting Coating Base G to prepare an off-white low-gloss electrophotographic paper (Paper A).

Good quality positive prints from both negative and positive microfilm originals were made on this paper by first charging with a corona charger, then exposing followed by development with a positively charged liquid developer. However, Paper A exhibited poor light stability and low resistance to coloration, showing a distinct yellowing after about one week exposure to normal fluorescent office lighting. Using the technique described previously regarding Paper A, an electrophotographic paper of this invention (Paper B) was prepared, except that the photoconductive solution was as follows:

| | |
|---|---|
| dichloromethane | 315 g |
| toluene | 104 g |
| Vitel® 101 (a polyester from Goodyear) | 45 g |
| 1,1,4,4-tetraphenyl-1,3-butadiene | 15 g |
| 4-(n-butylamino)-2-(4-methoxyphenyl)-benzo[b]pyrylium perchlorate | 0.36 g |
| Polyethylene beads, Microthene® FN500 | 0.6 g |

A much whiter appearing paper resulted. Good quality prints were made on this paper, using the technique described previously regarding Paper A, the images being comparable to those formed on Paper A. However, Paper B exhibited excellent photostability in that only a very faint trace of yellowing was observed in background areas upon prolonged exposure to room light.

EXAMPLE 2

An accelerated photostability test was conducted to demonstrate the relative improvement in electrophotographic elements of this invention over previous electrophotographic elements of purported low color. The test consisted of exposing samples of Paper A and Paper B from Example 1 for 24 hours to a high intensity xenon arc lamp (120,000 foot-candle hours) and tabulated in Table I below:

TABLE I

| | Percent Reflectance | | | | | |
|---|---|---|---|---|---|---|
| | Paper A | | | Paper B | | |
| Wavelength NM | Before Exposure | After Exposure | Change | Before Exposure | After Exposure | Change |
| 400 | 40.0 | 11.0 | 29.0 | 51.0 | 29.5 | 21.5 |
| 450 | 71.5 | 26.5 | 45.0 | 75.5 | 62.0 | 13.5 |
| 550 | 81.0 | 58.0 | 23.0 | 81.5 | 78.0 | 3.5 |
| 650 | 86.0 | 74.0 | 12.0 | 85.0 | 83.5 | 1.5 |

As can be seen from the test results in Table I, electrophotographic elements made in accordance with the teachings of this invention (Paper B) demonstrates a markedly improved stability and resistance to coloration upon exposure to light.

The invention has been described in detail with particular reference to certain preferred embodiments thereof, but it will be understood that variations and modifications can be effected within the spirit and scope of the invention.

There is claimed:

1. A coloration resistant photoconductive insulating composition comprising (1) an organic polymeric binder, (2) a nitrogen-free photoconductor of the formula:

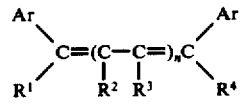

wherein

*n* represents an integer having a value of 0, 1 or

Ar represents an aryl group;

each of $R^1$, $R^2$, $R^3$ and $R^4$ represents a hydrogen atom, an aryl group, an alkyl group having 1 to about 10 carbon atoms in the alkyl moiety or an alkoxy group having 1 to about 10 carbon atoms in the alkoxy moiety and when *n* is 0, $R^1$ and $R^4$ are both aryl and when $R^1$ and $R^4$ are both hydrogen, $R^2$ and $R^3$ are aryl and (3) a substantially colorless benzopyrylium type sensitizer for the photoconductor.

2. A photoconductive insulating composition as described in claim 1 wherein *n* is an integer having a value of 0 or 1 and at least one of $R^1$ or $R^4$ is an aryl group when *n* is 1.

3. A photoconductive insulating composition as described in claim 1 wherein said benzopyrylium type sensitizer comprises a compound represented by the formula:

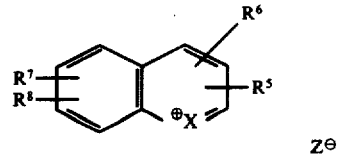

wherein:

X represents a sulfur atom or an oxygen atom,

Z represents an anion, $R^5$ represents an aryl group, $R^6$ represents an amino group, $R^7$ and $R^8$, when taken separately, each represents a hydrogen atom and when taken together are attached to adjacent carbon atoms and represent the atoms necessary to form a fused aromatic ring.

4. A photoconductive insulating composition as described in claim 3 wherein, in the formula for the photoconductor, *n* is an integer having a value of 0 or 1 and at least one of $R^1$ or $R^4$ is an aryl group when *n* is 1.

5. A photoconductive insulating composition as described in claim 3 wherein X is an oxygen atom; $R^5$ is a phenyl group substituted in the 2-position relative to X; $R^6$ is an alkyl- or alkoxyamino group having 1 to 18 carbon atoms in the alkyl or alkoxy moiety and is attached at the 4-position relative to X; and $R^7$ and $R^8$ each represent a hydrogen atom.

6. A photoconductive insulating composition as described in claim 5 wherein, in the formula for said photoconductor, *n* is an integer having a value of 0 or 1 and at least one f $R^1$ or $R^4$ is an aryl group when *n* is 1.

7. A photoconductive insulating composition as described in claim 2 wherein said benzopyrylium type sensitizer is selected from the group consisting of 4-n-butylamino-2-(4-methoxyphenyl)benzo[b]-pyrylium perchlorate 4-cyclohexylamine-2-phenylbenzo[b]thiapyrylium perchlorate, and 4-n-butylamino-2-(2-naphthyl)naphtha[1,2-b]pyrylium perchlorate.

8. A photoconductive insulating composition as described in claim 1 wherein said photoconductor is selected from the group consisting of 1,1,4,4-tetraphenyl-1,3-butadiene,
1,2,3,4-tetraphenyl-1,3-butadiene,
1,6-diphenyl-1,3,5-hexatriene,
1,1,4-triphenylbutadiene,
1,4-diphenyl-1,3-butadiene, and
tetraphenylethylene.

9. A coloration resistant photoconductive insulating composition comprising (1) an organic polymeric binder, (2) a nitrogen-free photoconductor of the formula:

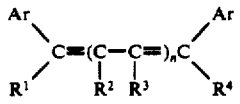

wherein

*n* represents an integer having a value of 0, 1 or

Ar represents an aryl group;

each of $R^1$, $R^2$, $R^3$ and $R^4$ represents a hydrogen atom, an aryl group, an alkyl group having 1 to about 10 carbon atoms in the alkyl moiety or an alkoxy group having 1 to about 10 carbon atoms in the alkoxy moiety and when *n* is 0, $R^1$ and $R^4$ are both aryl and when $R^1$ and $R^4$ are both hydrogen, $R^2$ and $R^3$ are aryl and (3) a sensitizer for the photoconductor selected from the group consisting of a benzo[b]pyrylium salt and a benzo[b]thiapyrylium salt.

10. A photoconductive insulating composition as described in claim 9 wherein the photoconductor is selected from the group consisting of 1,1,4,4-tetraphenyl-1,3-butadiene,
1,2,3,4-tetraphenyl-1,3-butadiene,
1,1,4-triphenylbutadiene,
1,4-diphenyl-1,3-butadiene, and
tetraphenylethylene.

11. A photoconductive insulating composition as described in claim 9 wherein the sensitizer is selected from the group consisting of 4-n-butylamino-2-(4-methoxyphenyl)benzo[b]-pyrylium perchlorate, 4-cyclohexylamine-2-phenylbenzo[b]thiapyrylium perchlorate and 4-n-butylamino 2-(2-naphthyl)naphtha[1,2-b]pyrylium perchlorate.

12. A photoconductive insulating composition as described in claim 9 wherein the sensitizer is present in an amount of from about 0.03 to about 0.6 percent by weight, based on the composition.

13. A coloration resistant photoconductive insulating composition comprising (1) an organic polymeric binder, (2) a nitrogen-free photoconductor of the formula

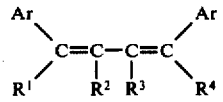

wherein Ar represents an aryl group and each of $R^1$, $R^2$, $R^3$ and $R^4$ represents a hydrogen atom, an aryl group, an alkyl group having 1 to about 10 carbon atoms in the alkyl moiety or an alkoxy group having 1 to about 10 carbon atoms in the alkoxy moiety and, when $R^1$ and $R^4$ are both hydrogen, $R^2$ and $R^3$ are both aryl, and (3) a substantially colorless benzopyrylium type sensitizer for the photoconductor.

14. A coloration resistant photoconductive insulating composition as described in claim 13 wherein the sensitizer for the photoconductor is selected from the group consisting of a benzo[b]pyrylium salt and a benzo[b]-thiapyrylium salt.

15. A photoconductive insulating composition as described in claim 13 wherein said benzopyrylium type sensitizer comprises a compound represented by the formula:

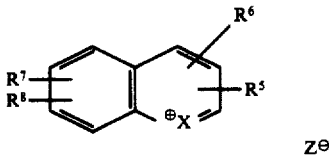

wherein:

X represents a sulfur atom or an oxygen atom,

Z represents an anion, $R^5$ represents an aryl group, $R^6$ represents an amino group, $R^7$ and $R^8$, when taken separately, each represents a hydrogen atom and when taken together are attached to adjacent carbon atoms and represent the atoms necessary to form a fused aromatic ring.

16. A photoconductive insulating composition as described in claim 15 wherein X is an oxygen atom; $R^5$ is a phenyl group substituted in the 2-position relative to X; $R^6$ is an alkyl- or alkylamino group having 1 to 18 carbon atoms in the alkyl or alkoxy moiety and is attached at the 4-position relative to X; and $R^7$ and $R^8$ each represent a hydrogen atom.

17. A photoconductive insulating composition as described in claim 13 wherein said benzopyrylium type sensitizer is selected from the group consisting of 4-n-butylamino-2-(4-methoxyphenyl)benzo[b]-pyrylium perchlorate 4-cyclohexylamine-2-phenylbenzo[b]thiapyrylium perchlorate, and 4-n-butylamino-2-(2-naphthyl)naphtha[1,2-b]pyrylium perchlorate.

18. A photoconductive insulating composition as described in claim 13 wherein the sensitizer is present in an amount of from about 0.03 to about 0.6 percent by weight, based on the composition.

19. An electrophotographic element comprising an electrically conducting support having thereon a coloration resistant photoconductive insulating composition as described in claim 1.

20. An electrophotographic element as described in claim 19 wherein the support comprises an electrically conducting paper.

21. An electrophotographic element comprising an electrically conducting support having thereon a coloration resistant photoconductive insulating composition comprising (1) an organic polymeric binder, (2) a photoconductor of the formula:

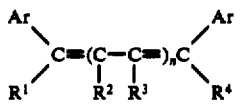

wherein

*n* represents an integer having a value of 0, 1 or 2;

Ar represents an aryl group;

each of $R^1$, $R^2$, $R^3$ and $R^4$ represents a hydrogen atom, an aryl group, an alkyl group having 1 to about 10 carbon atoms in the alkyl moiety or an alkoxy group having 1 to about 10 carbon atoms in the alkoxy moiety and when *n* is 0, $R^1$ and $R^4$ are both aryl and when $R^1$ and $R^4$ are both hydrogen, $R^2$ and $R^3$ are aryl and (3) a sensitizer for the photoconductor that is selected from the group consisting of a benzo[b]pyrylium salt and a benzo[b]thiapyrylium salt.

22. An electrophotographic element as described in claim 21 wherein the sensitizer is selected from the group consisting of a 4-aminobenzo[b]pyrylium salt and a 4-aminobenzo[b]-thiapyrylium salt.

23. An electrophotographic element as described in claim 21 wherein the support comprises an electrically conducting paper.

24. An electrophotographic element comprising an electrically conducting support having thereon a coloration resistant photoconductive insulating composition as described in claim 9.

25. An electrophotographic element comprising an electrically conducting support having thereon a coloration resistant photoconductive insulating composition comprising (1) an organic polymeric binder, (2) a nitrogen-free photoconductor of the formula

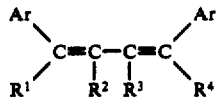

wherein Ar represents an aryl group and each of $R^1$, $R^2$, $R^3$ and $R^4$ represents a hydrogen atom, an alkyl group having 1 to about 10 carbon atoms in the alkyl moiety or an alkoxy group having 1 to about 10 carbon atoms in the alkoxy moiety and, when $R^1$ and $R^4$ are both hydrogen, $R^2$ and $R^3$ are both aryl, and (3) a substantially colorless benzopyrylium type sensitizer for the photoconductor.

26. An electrophotographic element as described in claim 25 wherein the sensitizer for the photoconductor is selected from the group consisting of a benzo[b]-pyrylium salt and a benzo[b]thiapyrylium salt.

27. An electrophotographic element as described in claim 25 wherein the support comprises paper.

28. An electrophotographic element as described in claim 25 wherein at least one of $R^1$ and $R^4$ is an aryl group.

* * * * *